United States Patent [19]

Okada

[11] Patent Number: 4,700,948

[45] Date of Patent: Oct. 20, 1987

[54] SLOT MACHINE WITH PLAYING CARD SYMBOLS

[75] Inventor: Kazuo Okada, Tokyo, Japan

[73] Assignee: Kabushiki Kaisha Universal, Tochigi, Japan

[21] Appl. No.: 794,407

[22] Filed: Nov. 4, 1985

[30] Foreign Application Priority Data

Nov. 2, 1984 [JP] Japan ..... 59-165687[U]

[51] Int. Cl.[4] ..... A63F 5/04

[52] U.S. Cl. ..... 273/143 R

[58] Field of Search ..... 273/143 R

[56] References Cited

U.S. PATENT DOCUMENTS 3,606,337 9/1971 Larsen et al. ..... 273/143 R 3,735,987 5/1973 Ohki ..... 273/143 R 4,431,191 2/1984 Weekes et al. ..... 273/143 R

*Primary Examiner*—Leo P. Picard

*Attorney, Agent, or Firm*—Young & Thompson

[57] ABSTRACT

A slot machine having five rotatable reels, each bearing on its outer periphery symbols of at least twelve different playing cards consisting of at least three cards of each suit and four out of 20 different cards consisting of the aces, tens and face cards of a deck of playing cards, and with spot cards numbered two through nine. Combinations of cards are displayed in horizontal rows at random during each game, and prizes are awarded when prize-winning combinations of cards corresponding to specified hands suitable for melding in a poker game occur on prize-winning rows previously selected. For selectively discarding any of the cards of an occurring combination, the slot machine is provided with pushbuttons which restart the rotation of a selected reel or reels.

10 Claims, 3 Drawing Figures

SLOT MACHINE WITH PLAYING CARD SYMBOLS

BACKGROUND OF THE INVENTION

The present invention relates to slot machines of the type which selects combinations of symbols at random during each game and awards prizes when predetermined prize-winning combinations occur on designated prize-winning rows and more particularly, to slot machines in which prize-winning combinations of symbols correspond to specified hands suitable for melding in a poker game.

As is well known in this art, slot machines have a plurality, for instance three, of rotatable reels each of which is provided with an annular row of various symbols on the outer peripheral surface thereof. During a game, each reel is caused to rotate, and is stopped at random at one of three possible stop positions in each of which is displayed a corresponding symbol in a window. The slot machine awards prizes when predetermined prize-winning combinations occur on designated prize-winning rows.

Because the symbols used differ among the various types of slot machines, players are often not accustomed to immediately discriminating the occurring prize-winning combinations of different symbols. Thus, the feeling of satisfaction, to say nothing of the thrill of completing a prize-winning combination, which is primarily enjoyed at the moment when the reels stop, is lost.

OBJECT OF THE INVENTION

It is therefore an object of the present invention to provide a slot machine in which combinations of symbols occurring on designated prize-winning rows can be quickly and clearly discriminated at first sight even by beginners.

It is another object of the present invention to provide a slot machine in which at least a deck of playing cards is used as symbols so as to select the same combinations as specified hands suitable for melding in a poker game as prize-winning combinations of symbols.

It is still another object of the present invention to provide a slot machine in which one or a plurality of lengthwise movable series of different symbols can be selectively restarted for discarding any card or cards of a previously occurring combination of cards so as to create another combination of cards.

It is a further object of the present invention to provide a slot machine of simple design and which is also inexpensive to manufacture.

SUMMARY OF THE INVENTION

To accomplish the above-mentioned objects, the slot machine in accordance with the present invention comprises five lengthwise movable series of different symbols of playing cards which include at least a deck of playing cards, means to select combinations of symbols of cards at random during each game, and means to award prizes when the same combinations of cards as specified hands suitable for melding in a poker game occur on prize-winning rows. The slot machine in accordance with the present invention further comprises means which provides for discarding, by selectively changing a card or cards in the previously occurring combination of cards.

A distinctive feature of the slot machine in accordance with the present invention lies in the fact that each series of cards includes at least twelve different cards which consist of three cards of every suit, and which include any four out of the 20 different cards comprised by the aces, tens and face cards of the four suits of the deck of playing cards.

Thus the five lengthwise movable series of cards can provide almost all of the combinations of cards specified as poker hands suitable for melding. On the other hand, to discard any card or cards of a combination of cards that has occurred, any one or more of the lengthwise movable series of cards can be selectively restarted merely by operating associated means such as a button or buttons.

BRIEF DESCRIPTION OF THE DRAWINGS

These and other features and advantages of the present invention will be described in more detail in the following, by way of an example, reference being made to the accompanying drawings, in which.

DETAILED DESCRIPTION OF THE INVENTION

Figure 1:
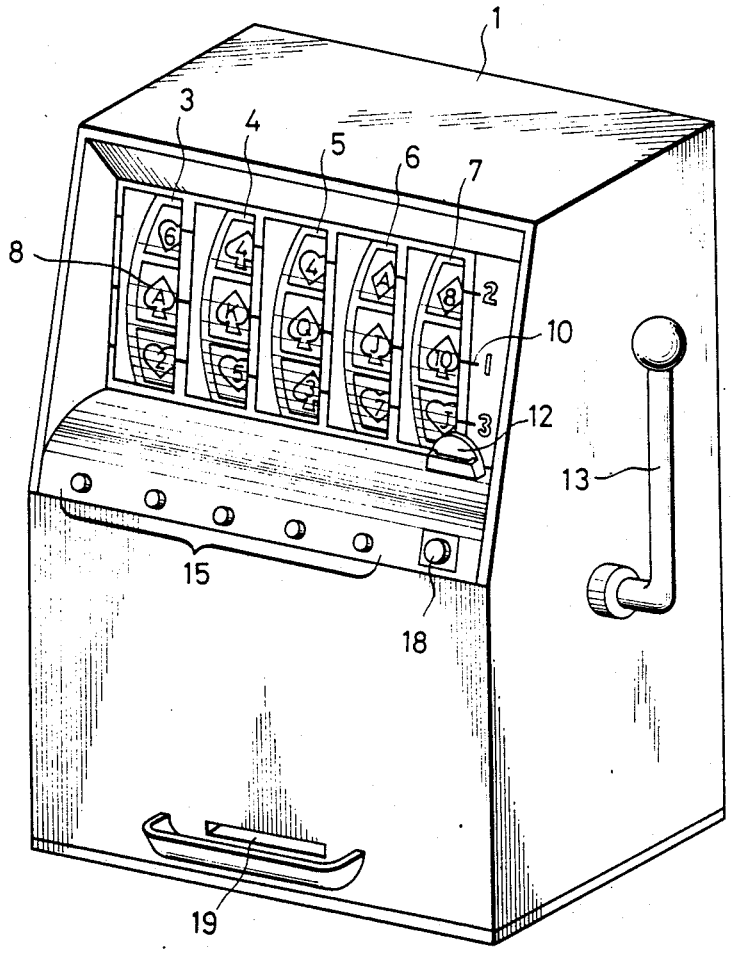
FIG. 1 is a perspective view showing an embodiment of the slot machine according to the present invention.

Referring now to FIG. 1, shown therein is a slot machine according to the present invention which comprises a set of reels 3 to 7, namely first to fifth, mounted side by side on a common shaft in a housing 1 so as to be individually rotatable. Each of the reels 3 to 7 is provided with an annular row of symbols 8 of playing cards, each of which consists of a suit mark and a value mark, on the outer surface thereof. During a game, each reel is stopped at random at one of the possible stop positions in each of which it displays three successively corresponding symbols to a player in one of the windows formed in the front panel. Three transverse rows of combinations of symbols on the reels 3 to 7 which are aligned in any one of the three prizewinning lines 10 win prizes when any combination of symbols occurs corresponding to any of a plurality of predetermined prize-winning combinations. In practice, a player can select the prize-winning row or rows in accordance with the number of coins inserted into the slot machine through a coin slot 12 prior to playing a game.

Upon pulling a start arm 13 provided on one side of the housing 1 after the insertion of coins, the reels 3 to 7 are started to rotate simultaneously. After a certain time has elapsed, the reels 3 to 7 are stopped at random based on random programmed numbers, each at one of the possible stop positions, and so display corresponding symbols to the player through the associated windows.

Corresponding to the respective reels 3 to 7, the slot machine is provided on its operation panel with discard buttons 15 for selecting the reel or reels for changing the symbols displayed in the windows, like discarding in a poker game. The resumed rotation of the selected reel or reels is effected by pushing a restart button 18 on the operation panel after pushing the associated discard button or buttons 15. After this, the selected reels are stopped at random as in the case of the usual plays, and so display new symbols corresponding to the stopped positions. If the restart button 18 is pushed without selecting any of the discard buttons 15, the respective reels 3 to 7 are all restarted to rotate, and are stopped with the combination of symbols unchanged.

At the end of a game, when any combination of symbols on the selected prize-winning row or rows occurs corresponding to any of a plurality of particular hands of cards in a poker game, the slot machine pays out coins of a number corresponding to the hand or hands displayed, through a spout 19 into a coin receptacle.

The slot machine is adapted to allow inserting a number of coins thereinto through the coin slot 12 for several games prior to the play of a game whether or not coins are also inserted before every game. The coins inserted are sensed by sensing means which provides pulse signals, corresponding to the number of the coins, which are counted by a pulse counter. The counter counts down by a number corresponding to the number of coins spent and counts up by a number equal to the number of coins to be paid out as prizes every game. In this case, coins corresponding to the total counted number are paid out when the player is through.

Figure 2:
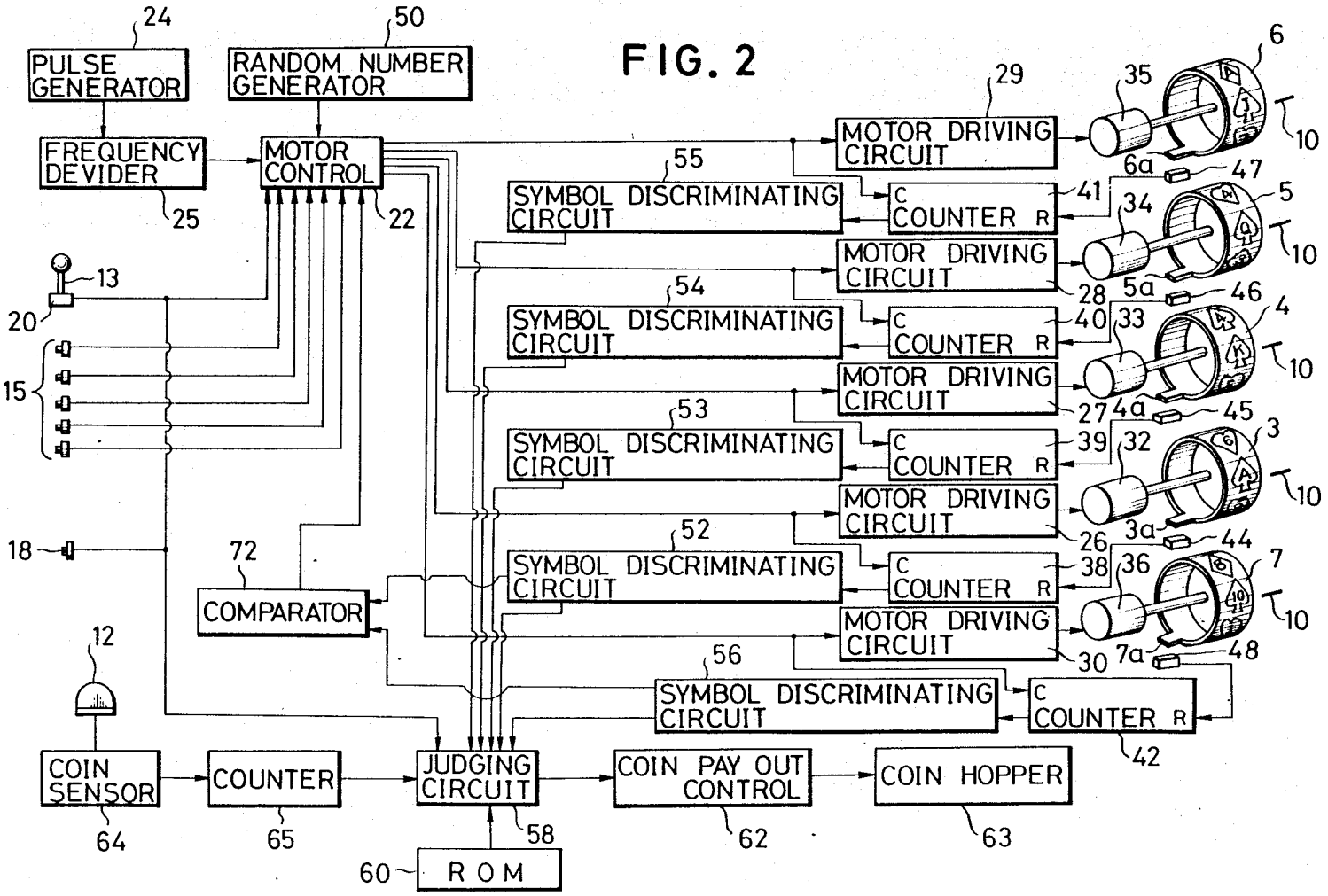
FIG. 2 is a block diagram showing an electrical circuit for the slot machine of FIG. 1.
Figure 3:
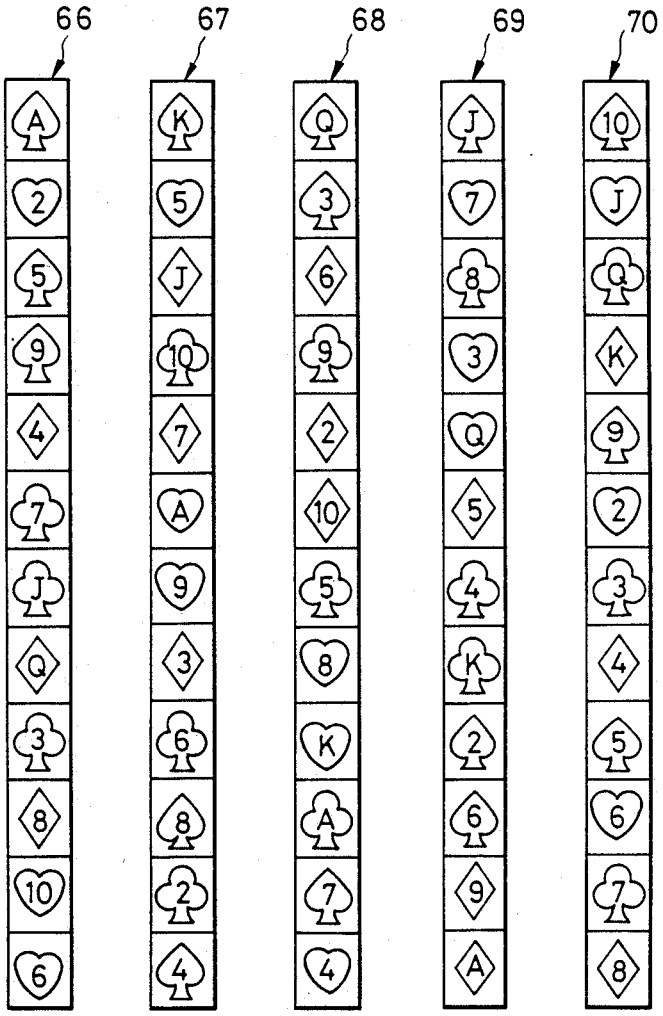
FIG. 3 shows an embodiment of the annular rows of symbols which are provided on the outer peripheral surfaces of the reels.

Referring now to FIG. 2, there is shown therein, in a block diagram, a control circuit for the slot machine described above with reference to FIG. 1.

Upon pulling the start arm 13, a signal producer 20 provides a pulse signal which in turn, is transmitted to the motor control 22 for the actuation thereof. The motor control 22 is actuated by receiving a pulse signal from a pulse generator 24 which has been modulated to a certain frequency by a frequency divider 25, and delivers a control signal to motor driving circuits 26 to 30 so as to cause stepping motors 32 to 36 to rotate. The stepping motors 32 to 36 thus caused to rotate, cause the respective associated reels 3 to 7 to rotate simultaneously.

Counters 38 to 42 associated with the respective reels 3 to 7 commence counting up the pulses delivered to the respective motor driving circuits 26 to 30. Therefore, the respective reels 3 to 7 occupy positions corresponding to the counts of the respective counters 38 to 42. On the other hand, the counted values, on the basis of which it is determined which symbols are displayed in the windows (this will be described in detail later), are reset to initial value, for example zero (0) every one rotation. For this purpose, the reels 3 to 7 are provided on their periphery with projections *3a* to *7a* which cooperate with photosensors 44 to 48, respectively, so as to provide, every time the projections pass the photosensors, signals each of which in turn is directed to the respective counter 38 to 42 to reset its content to zero.

After the speed of each reel has reached a certain rate, a random number generator 50 is actuated to provide stop pulses which in turn are directed at random to the motor control 22 and shut it off to stop the delivery of pulse signals to the motor driving circuits 26 to 30. As a result of this, the stepping motors 32 to 36 and hence the reels 3 to 7 are stopped at random. Because the number of pulse signals required for one rotation of the stepping motors 32 to 37, i.e. the reel 3 to 7 is always a constant, and because the symbols on the respective reel 3 to 7 are arranged in a prescribed order, it can be detected with reference to the content of the counter, which symbols are displayed in the window.

At the time the respective reels 3 to 7 are stopped, symbol discriminating circuits 52 to 56 retrieve the contents of the respective counters 38 to 42 as signals to determine which symbols are displayed in the respective windows. A set of these signals, which represents a combination of symbols, is transmitted to judging means 58 from the symbols discriminating circuits 52 to 56. At this time, the set of signals is compared in the judging means 58 with each of the various prize-winning combinations of symbols which are memorized as coded signals in ROM 60. The decision that there has occurred a prize-winning combination of symbols is made, based on the correspondence between these signals. When the upper and/or lower, and middle transverse rows are designated as prize-winning rows according to the number of coins inserted into the slot machine, a signal is delivered from a counter 65 to the judging means 58 and causes it to compare two sets of signals with each prize-winning combination of signals memorized in ROM 60. The second set of signals is automatically emitted based on the first set of signals which consists of the signals from the symbol discriminating circuits 52 to 56, because the counted numbers of pulse signals have one-to-one correspondence with the respective symbols arranged in the prescribed order on the outer peripheral surface of each corresponding reel.

When a determined prize-winning combination occurs on a prize-winning line or lines, a prize signal is applied to a pay-out control 62 which causes a coin hopper 63 to pay out coins of a corresponding number.

When the restart button 18 is pushed without pushing any of the discard buttons 15, the set of signals which represents the combination of symbols that occurred before the reels 3 to 7 are restarted to rotate, is retained unchanged.

When discarding, that is, when the restart button 18 is pushed following the selection of the reel or reels to be restarted for discarding after the reels 3 to 5 have initially stopped, the decision whether there has occurred a prize-winning combination of symbols is deferred temporarily. Responsive to the pushing the restart button 28, a signal is provided to actuate the motor control 22 so as to start the selected reel or reels to rotate again. After a certain time has elapsed, the selected reel or reels is stopped at random based on signals which are provided from the random number generator 50, and only then is the decision made whether there has occurred a prize-winning combination of symbols, in the same manner as described hereinbefore.

In a poker game, there are specified various combinations of cards suitable for melding, for instance a flush, a straight flush and the like, in which all the cards in one hand must be of the same suit, or a full house, three of a kind, two pairs and the like, in which the cards are not of the same suit, and the like. When distributing at random the symbols corresponding to a deck of cards, i.e. 52 different playing cards, among the five reels, it is impossible to provide all of such specified combinations of card. Although it may of course be conceivable to arrange an entire deck of cards on each reel for providing all of such specified combinations of cards, this would make the reels too large and so would be an unfeasible solution.

Having regard for these circumstances, according to the present invention, the reels 3 to 7 are provided on their outer peripheral surfaces with rows 66 to 70 of symbols, each of which consists of 12 different cards, that is, 12 different combinations of suits and values. More specifically, each symbol row of 12 different cards includes three cards from each suit and includes four of the 20 different cards consisting of aces, tens and face cards in such a way that two or more cards of the same suit will not be included in the same symbol row. As will be apparent form the above, each symbol series includes eight spot cards numbered two through nine, although the fifth reel 7 may include seven spot cards.

The reels 3 to 7 include all 52 of the different playing cards in a deck, but not in order. However, one of the reels, for example the fifth reel 7, would include eight blanks left in its symbol row 70 if only a deck of playing cards were distributed among the reels 3 to 7. But what would otherwise be the eight blanks in the symbol row 70 on the reel 7 are in fact filled with eight different cards which are artibrarily chosen from another deck of playing cards.

In such an arrangement of playing cards, using at least two decks, it will be evident that there are many chances to include two identical cards in a combination of five cards on a transverse row in a game. For avoiding such an improper combination of five cards, in accordance with this invention, the symbol row 70 on the fifth reel 7 includes the same spot cards numbered two through nine as in the symbol row 66 on the first reel 3, and two cards on the rotating reels 3 and 7 which are derived as signals by the symbol discriminating circuit 52 and 56 are exceptionally compared with each other in comparing means 72 which is adapted to control the operation of the motor control 22 so as to transmit more pulse signals to the motor driving circuit 30 than to the other motor driving circuits 26–29 when the occurrence of a combination of two identical cards on the reels 3 and 7 in the windows is detected.

It should be noted that the provision of the comparing means 72 can be eliminated by providing the fifth reel 7 with the repeated arrangement of said four cards out of 20 different cards consisting of aces, tens and face cards. This results in a simplified construction of the slot machine.

Although the foregoing description has been given for the example in which each reel of the first to fifth reels 3 to 7 is provided with a symbol row consisting of 12 different cards so as preferably to preclude the occurrence of a combination of cards in which two identical cards are included, it may be of course possible to provide on each of the reels 3 to 5 a symbol row consisting of 13 cards or more. In this case, the avoidance of including two same cards in a combination of cards can be realized by additional comparing means. The discarding buttons 15 and the restart button 18 may be omitted so as to finish a game when the reels 3 to 7 are stopped. The random number generator 50 can be replaced with stop buttons associated with the respective reels 3 to 7, the stop buttons being operated by players to stop the reels 3 to 7 after the reels 3 to 7 have reached a certain speed.

As will be apparent to those skilled in the art, the present invention is also applicable to slot machines of the type which use a simulated video display of rotating reels on a CRT screen. In such a slot machine, the arrangement of at least twelve different cards on every reel makes it possible to provide almost all types of specified combinations of cards for melding in a poker game, so a reduced number of memory entries and program memory units for displaying cards and discriminating combinations of cards, respectively, can satisfy the requirements of this type of slot machine.

Although this invention has been described with reference to a particular embodiment, it will be understood by those skilled in the art that this invention is also capable of further and other embodiments within the spirit and scope of the appended claims.

What is claimed is:

1. A slot machine adapted to provide combinations of symbols on prize-winning lines in a window, said slot machine comprising:

means for displaying five lengthwise individually movable series of symbols in which at least 52 different playing cards of a deck are distributed, said five series of symbols being started to move and then stopped to provide combinations of five symbols on said prize-winning lines; and position control means for stopping said five series of symbols so as to prevent the same symbols of cards from appearing simultaneously in said window.

2. A slot machine as defined in claim 1, wherein each of said five series of symbols includes at least 12 different cards which consist of at least three cards of each suit and at least four out of 20 different cards consisting of the aces, tens and face cards of said deck of playing cards.

3. A slot machine as defined in claim 2, wherein said each series includes eight spot cards numbered two through nine.

4. A slot machine as defined in claim 2, further comprising means for selectively moving any of said five series of cards for discarding after a combination of cards has been displayed.

5. A slot machine as defined in claim 2, wherein one of said five series of cards includes the same cards as the eight spot cards numbered two through nine in one of the remaining series of symbols of cards.

6. A slot machine as defined in claim 1, wherein each of said five series of cards is arranged on the outer peripheral surface of a reel which is rotated by a stepping motor.

7. A slot machine as defined in claim 5, wherein said position control means includes detecting means adapted to detect duplicates between said two particular series of symbols of cards.

8. A slot machine adapted to award prizes when prize-winning combinations occur on prize-winning lines in a window, said slot machine comprising:

means for displaying five lengthwise individually movable series of symbols in which at least 52 different playing cards of a deck are distributed, said five series of symbols being started to move and then stopped at random to provide a combination of five symbols on said prize-winning lines;

means for detecting when the same symbol is duplicated for two cards displayed in said window; and means for again moving at least one of said series of symbols in which said duplicated symbol of cards is included, under the control of said detecting means, so as to prevent the same symbol of cards from appearing simultaneously in said window when said five series of symbols are stopped.

9. A slot machine adapted to provide a combination of symbols on a plurality of winning lines in a window, said slot machine comprising:

means for displaying five lengthwise individually movable series of symbols in which at least 52 different playing cards of a deck are distributed, each of said five series of symbols including at least 12 different cards which consist of at least three cards of each suit, at least four out of 20 different cards consisting of the aces, tens and face cards of a deck of playing cards, and at least eight spot cards numbered two through nine, one of said five series of symbols of cards including the same cards as the eight spot cards numbered two through nine in one of the other series of symbols of cards; and means for preventing said same cards from appearing simultaneously on said two particular series of symbols in said window.

10. A slot machine adapted to award prizes when prize-winning combinations occur on prize-winning lines, said slot machine comprising:

means for displaying five lengthwise individually movable series of symbols in which at least 52 different playing cards of a deck are distributed, said five series of symbols being started to move and then stopped to provide combinations of symbols on said prize-winning lines; and position control means for stopping said five series of symbols so as to prevent the same symbols of cards from appearing simultaneously on said prize-winning lines.

* * * * *